US005629661A

United States Patent [19]

Ooi et al.

[11] Patent Number: 5,629,661

[45] Date of Patent: May 13, 1997

[54] CHOKE COIL FOR ELIMINATING COMMON MODE NOISE AND NORMAL MODE NOISE

[75] Inventors: Takaaki Ooi, Takefu; Kouichi Yamaguchi; Tatsuyuki Yamada, both of Fukui-ken; Iwao Fukutani, Takefu, all of Japan

[73] Assignee: Murata Manufacturing Co., Ltd., Nagaokakyo, Japan

[21] Appl. No.: 597,462

[22] Filed: Feb. 2, 1996

[30] Foreign Application Priority Data

Feb. 3, 1995 [JP] Japan ..... 7-017159

[51] Int. Cl.[6] ..... H01F 27/26; H01F 27/30

[52] U.S. Cl. ..... 336/198; 336/212; 336/215

[58] Field of Search ..... 336/212, 83, 198, 336/214, 215, 210

[56] References Cited

U.S. PATENT DOCUMENTS 1,771,297 7/1930 Howes ..... 336/215

4,866,409 9/1989 Umezaki ..... 336/212

*Primary Examiner*—Thomas J. Kozma

*Attorney, Agent, or Firm*—Burns, Doane, Swecker & Mathis, LLP

[57] ABSTRACT

A choke coil having a sufficient noise eliminating effect against common mode and normal mode noises. The choke coil has a bobbin, a pair of windings wound around the bobbin, and magnetic cores inserted in a rectilinear body portion of the bobbin. The bobbin is constituted by a main body and a cap each of which incorporates a magnetic core. The upper half of those magnetic cores forms a closed magnetic circuit that extends around one of the windings while the lower half forms a closed magnetic circuit that extends around the winding.

6 Claims, 4 Drawing Sheets

CHOKE COIL FOR ELIMINATING COMMON MODE NOISE AND NORMAL MODE NOISE

BACKGROUND OF THE INVENTION

1. Field of the Invention

The present invention relates to a choke coil which is primarily used for eliminating noises generated by electronic equipment and the like.

2. Description of the Related Art

There are two modes for circulating noise. One is a normal mode (a differential mode) which circulates noise by generating a voltage difference between power supply lines. The other is a common mode which circulates noise by generating a voltage difference between the power supply lines and ground, but without a voltage difference between the power supply lines. The noise current direction of the normal mode is in the same direction as the current direction of the power supply. The noise current direction of the common mode follows a different loop than the current of the power supply. Choke coils are designed to reduce or eliminate these types of noise.

A common mode choke coil generally includes normal mode leakage inductance components, although at a low level. It is therefore effective also for normal mode noises. However, for normal mode noises at a high level, it has been necessary to use a separate normal mode choke coil to eliminate the noises.

In the case of a common mode choke coil having normal mode leakage inductance components at a relatively high level, leakage flux has sometimes adversely affected adjacent circuits. This has necessitated countermeasures such as a magnetic shield provided around a common mode choke coil.

Since it has not been possible for a single conventional choke coil to eliminate both common mode and normal mode noises sufficiently, in order to eliminate both common mode and normal made noises, it has been necessary to mount two choke coils, i.e., a common mode choke coil and a normal mode choke coil, on a printed circuit board or the like. This has resulted in a problem in that a large area is consumed on the printed circuit board or the like.

Further, a magnetic shield provided around a choke coil has led to an increase in the cost of the choke coil. It is therefore an object of the present invention to provide a choke coil having a sufficient noise eliminating effect against common mode and normal mode noises.

SUMMARY OF THE INVENTION

In order to achieve the above-described object, according to the present invention, there is provided a choke coil characterized in that it includes:

(a) a pair of windings;

(b) a bobbin having a main body including a body portion around which the pair of windings are wound and a flange portion provided on the body portion and a cap bonded to a circumferential end face of the flange portion of the main body, the bobbin incorporating a first magnetic core which surrounds each of the pair of windings; and (c) a second magnetic core forming a closed magnetic circuit one side of which is inserted in a hole in the body portion.

With the above-described configuration, when a common mode noise current flows through the pair of windings, magnetic fluxes are generated at each winding. The magnetic fluxes are combined with each other and the combined flux is attenuated as a result of the conversion of the same into thermal energy in the form of eddy current loss or the like that occurs in the magnetic circuit. This eliminates the common mode noise current. On the other hand, when a normal mode noise current flows through the pair of windings, magnetic flux is generated at the windings. This magnetic flux circulates the magnetic cores incorporated in the bobbin and is attenuated as a result of the conversion of the same into thermal energy in the form of eddy current loss or the like. This eliminates the normal mode noise current.

The incorporation of the magnetic cores into the bobbin allows the choke coil to be made compact. In addition, since the main body and cap of the bobbin are provided as separate elements, operations such as winding can be carried out in the same manner as for conventional choke coils when the cap is not bonded to the main body.

DETAILED DESCRIPTION OF THE PREFERRED EMBODIMENT

An embodiment of a choke coil according to the present invention will now be described with reference to the accompanying drawings.

Figure 1:
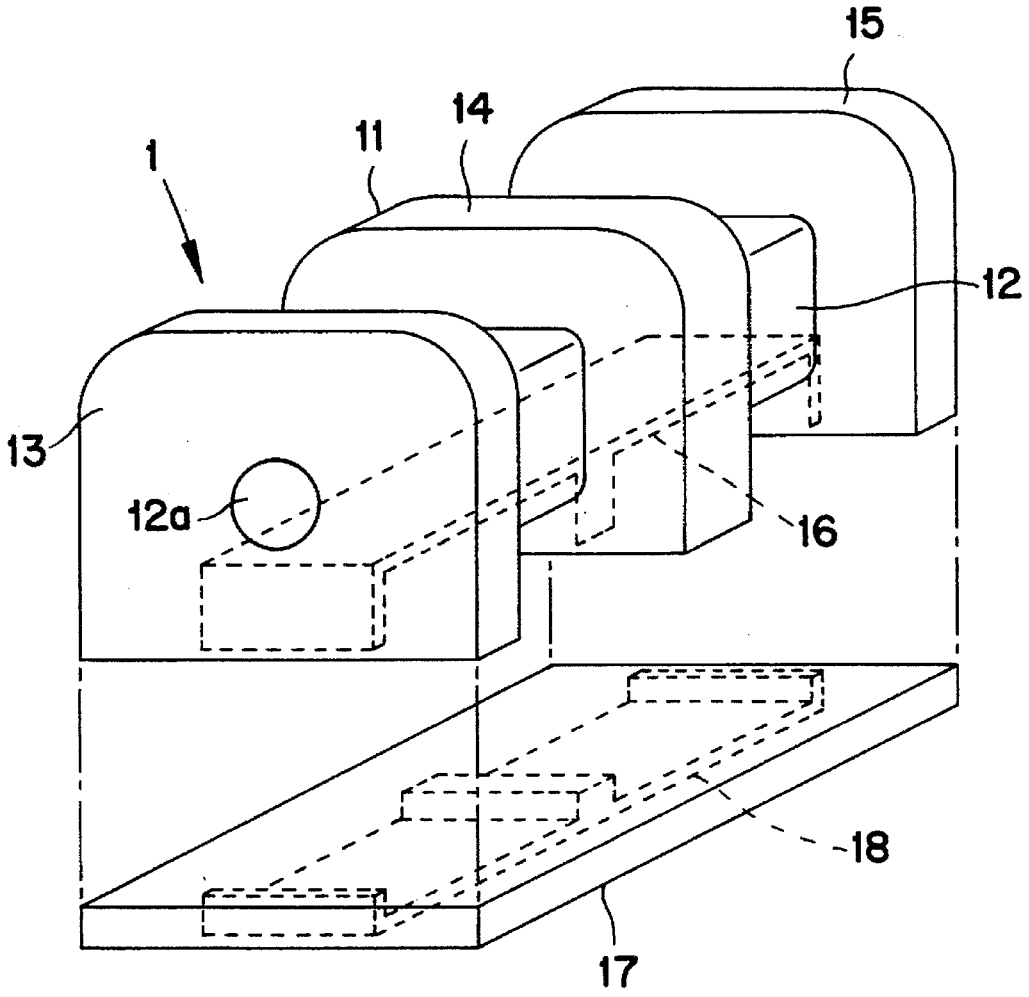
FIG. 1 is a perspective view of a bobbin used in an embodiment of a choke coil according to the present invention.

FIG. 1 is a perspective view of a bobbin 1 used in a choke coil of the present embodiment. The bobbin 1 has main body 11 constituted by a rectilinear body portion 12, flange portions 13, 14, and 15 provided on both ends and in the middle of the rectilinear body portion 12, and a cap 17 bonded to circumferential end faces of the flange portions 13, 14, and 15. The rectilinear body portion 12 has a hole 12*a* whose transverse section is circular. However, it goes without saying that the hole may have any transverse sectional shape, e.g., a rectilinear shape. The cap 17 is in the form of a board and is bonded to a lower circumferential end face of each of the flange portions 13, 14, and 15 using adhesive or the like after windings 4 and 5, to be described later, are wound around the body portion 12. Materials which can be used for the bobbin 1 include polybutylene terephthalate resin, polyphenylene sulfide resin, and polyethylene terephthalate resin.

Further, a first magnetic core constituted by magnetic cores 16 and 18 are incorporated in the lower part of the bobbin 1 by means of insert molding or the like. Specifically, the E-shaped magnetic core 16 is disposed inside the body portion 12 of the main body 11 (beneath the hole 12*a*) and inside the flange portions 13, 14, and 15 and is partially exposed at a lower circumferential end face of each of the flange portions 13, 14, and 15. The substantially 1-shaped magnetic core 18 is disposed inside the cap 17 and is partially exposed in the areas on the upper side of the cap 17 which are bonded to the flange portions 13, 14, and 15. Therefore, when the main body 11 and the cap 17 are bonded together, the exposed portions of the magnetic core 16 and 18 contact with each other to form a B-shaped magnetic circuit. For the magnetic cores 16 and 18, magnetic materials having relative permeability of 1 or more (e.g., 2 to several hundred) are used. Specifically, usable materials include Ni-Zn type or Mn-Zn type ferrite and a dust core.

Figure 2:
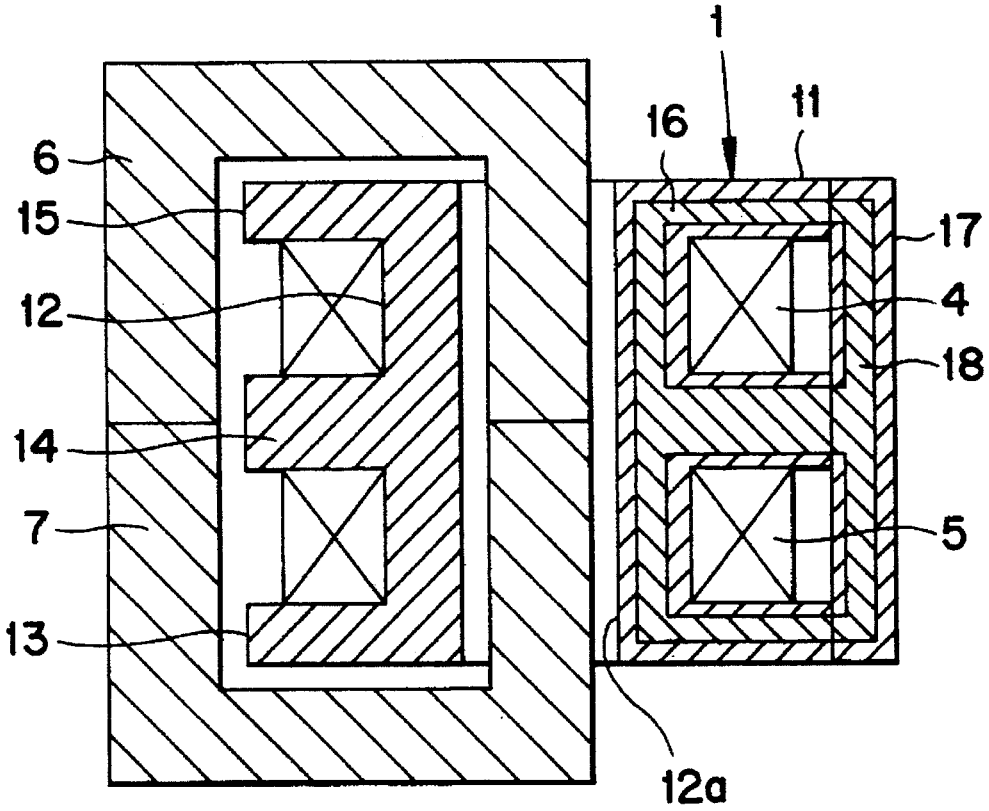
FIG. 2 is a sectional view of an embodiment of a choke coil according to the present invention.

FIG. 2 shows a choke coil in which a bobbin 1 having above-described structure is used. The choke coil is constituted by the bobbin 1, a pair of windings 4 and 5 each of which is wound around the bobbin 1, and two U-shaped magnetic cores 6 and 7, which when inserted into the hole 12*a* form a second magnetic core forming a closed magnetic circuit. Each of the pair of windings 4 and 5 is wound around the body portion 12 of the bobbin 1 so that they are on either side of the flange portion 14. The starting and terminating ends of each winding are fixed to terminals (not shown) provided on the bobbin 1. In FIG. 2, the bobbin 1 forms a closed magnetic circuit which extends around the winding 4 at the upper half of the magnetic cores 16 and 18 and a closed magnetic circuit which extends around the winding 5 at the lower half of the magnetic cores 16 and 18.

The magnetic cores 6 and 7 are inserted in the hole 12*a* of the body portion 12 of the bobbin 1 and are bonded together to form a D-shaped core. Materials having relative permeability of several thousands are preferable for the cores 6 and 7. Specifically, ferrite and amorphous materials and the like are used.

The choke coil having the above-described configuration is compact and occupies only a small area on a printed circuit board or the like because of the magnetic cores 16 and 18 being incorporated in the bobbin 1. Moreover, since the main body 11 and the cap 17 of the bobbin 1 are provided as separate elements, a winding operation can be carried out before the cap 17 is bonded to the main body 11 using conventional facilities and methods for fabricating a choke coil.

Figure 3:
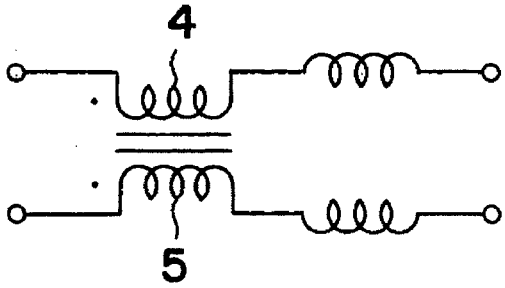
FIG. 3 is an electrical equivalent circuit diagram of the choke coil shown in FIG. 2.

FIG. 3 shows an electrical equivalent circuit diagram of this choke coil.

A common mode noise eliminating action of a choke coil having the above-described configuration will now be described with reference to FIG. 4 and FIG. 5.

Figure 4:
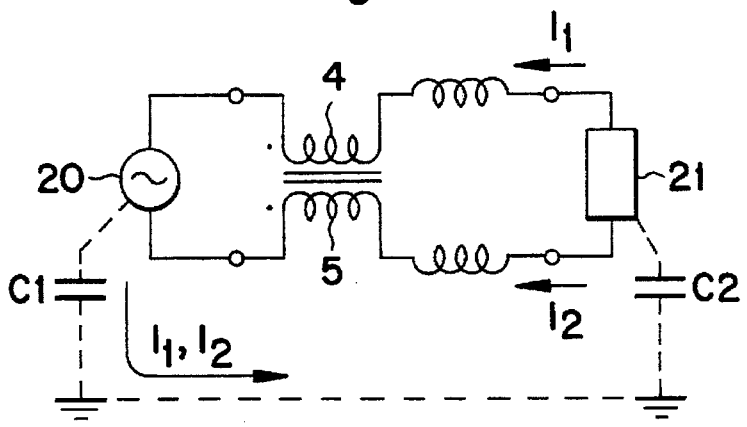
FIG. 4 is an electrical circuit diagram for explaining the elimination of common mode noises using the choke coil shown in FIG. 2.
Figure 5:
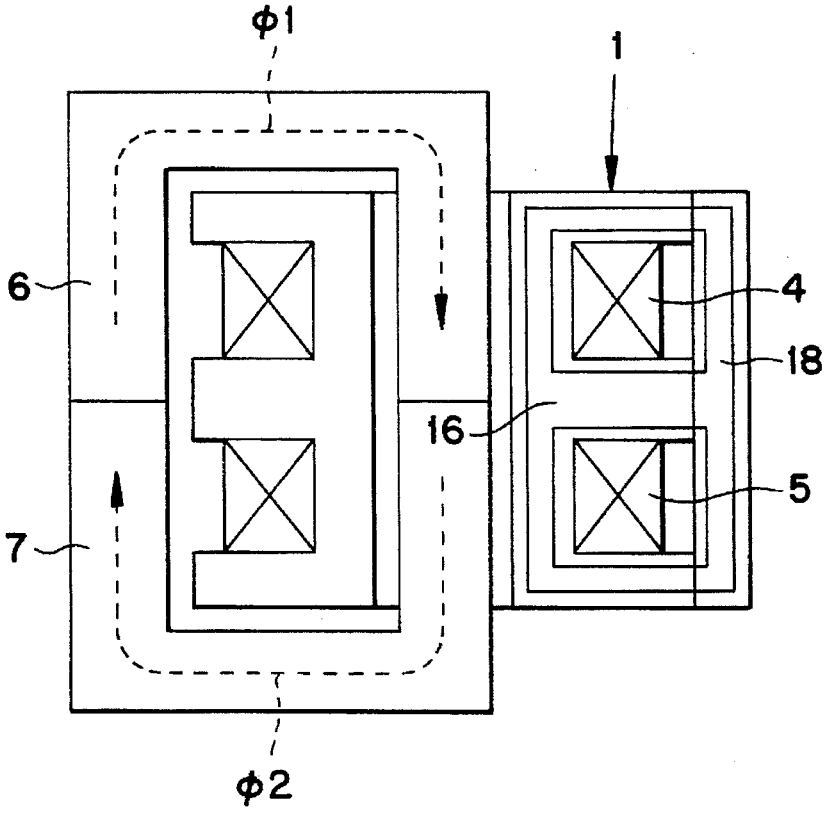
FIG. 5 is a magnetic circuit diagram for explaining the elimination of common mode noises using the choke coil shown in FIG. 2.

As shown in FIG. 4, the choke coil is electrically connected to two signal lines provided between a power supply 20 and a load 21 such as an electrical apparatus. A stray capacity C1 is generated between the power supply 20 and the ground, and a stray capacity C2 is generated between the load 21 and the ground. When common mode noise currents $i_1$ and $i_2$ flow through the two signal lines in the directions indicated by the arrows in FIG. 4, as shown in FIG. 5, windings 4 and 5 generate magnetic flux $\phi 1$ and $\phi 2$, respectively. The combination of the magnetic flux $\phi 1$ and $\phi 2$ gradually attenuates without leaking out while it circulates through the closed magnetic circuit constituted by the cores 6 and 7. This is a result of the conversion of the magnetic flux $\phi 1$ and $\phi 2$ into thermal energy in the form of eddy current loss or the like. Thus, the common mode noise currents $i_1$ and $i_2$ are reduced.

Next, a normal mode noise eliminating action of the choke coil will now be described with reference to FIG. 6 and FIG. 7.

Figure 6:
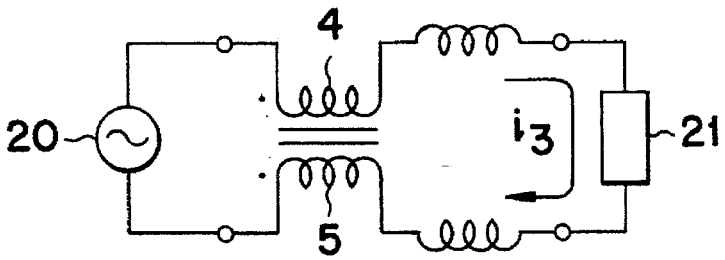
FIG. 6 is an electrical circuit diagram for explaining the elimination of normal mode noises using the choke coil shown in FIG. 2.
Figure 7:
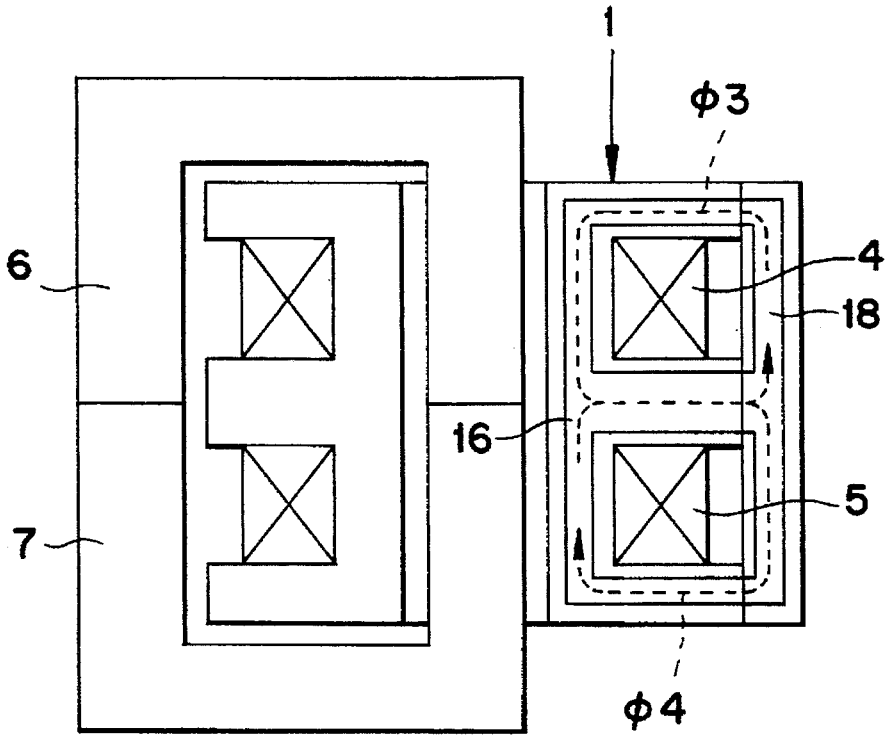
FIG. 7 it a magnetic circuit diagram for explaining the elimination of normal mode noises using the choke coil shown in FIG. 2.

As shown in FIG. 6, when a normal mode noise current $i_3$ flows through each of the two signal lines in the directions indicated by the arrows in FIG. 6, as shown in FIG. 7, the windings 4 and 5 generate magnetic flux $\phi 3$ and $\phi 4$, respectively. The combination of the magnetic flux $\phi 3$ and $\phi 4$ is gradually attenuated as a result of the conversion of the same into thermal energy in the form of eddy current loss or the like which occurs while it circulates through the closed magnetic circuit formed by the magnetic cores 16 and 18 incorporated in the bobbin 1 without leaking out. Thus, the normal mode noise current $i_3$ is reduced.

A choke coil according to the present invention is not limited to the above-described embodiment and various modifications may be made thereto without departing from the principle of the present invention.

It is not essential that a single common bobbin is used for a plurality of windings. Instead, a plurality of independent bobbins may be provided for respective windings. The shape of the body portion may be either cylindrical or prismatic, i.e. , have a circular or rectilinear cross-section.

Further, in addition to the combinations of two U-shaped cores and E-shaped cores, the magnetic cores may be obtained by combining U-shaped and E-shaped cores with I-shaped cores. The cores are not limited to split type cores, and integral type cores such as B-shaped and D-shaped cores may be used.

As apparent from the above description, according to the present invention having a bobbin incorporating a magnetic core which surrounds each of a pair of windings and a magnetic core forming a closed magnetic circuit one side of which is inserted in the bobbin, the magnetic flux generated by a common mode noise current and a normal mode noise current flowing through the pair of windings is attenuated as a result of the conversion of the same into thermal energy in the form of eddy current loss or the like that occurs in the respective magnetic cores and the magnetic cores incorporated in the bobbin. As a result, the common mode and normal mode noises are eliminated. Further, since the magnetic flux does not leak out the choke coil, the need for a magnetic shield around the choke coil is eliminated.

In addition, since one of the pairs of magnetic cores is incorporated in the bobbin, it is possible to provide a compact choke coil which occupies only a small area on a printed circuit board or the like. Since the main body and cap of the bobbin are separate elements, operations such as winding can be carried out using the same facilities and procedures as for conventional choke coils, which results in a reduction in manufacturing cost.

While a specific illustrated embodiment has been shown and described, it will be appreciated by those skilled in the art that various modifications, changes and additions can be made to the invention without departing from the spirit and scope thereof as set forth in the following claim.

What is claimed is:

1. A choke coil comprising:

a pair of windings;

a bobbin having a main body including a body portion around which said pair of windings are wound, flange portions provided on the body portion, and a cap bonded to a circumferential end face of each of said flange portions of the main body, said bobbin incorporating a first magnetic core which surrounds at lust a segment of each of said pair of windings, wherein said first magnetic core forms a closed magnetic circuit for eliminating normal mode noise and wherein said first magnetic core having a first core portion in said main body and a second core portion in said cap; and a second magnetic core separated and offset from said first magnetic core forming a closed magnetic circuit for eliminating common mode noise one side of which is inserted in a hole in said body portion.

2. A choke coil in accordance with claim 1 wherein said body portion is elongated, said hole being axially disposed in said elongated body portion.

3. A choke coil in accordance with claim 1 wherein said flange portion includes three flanges, two of which are located on ends of said body portion and a third being located between said two ends of said body portion.

4. A choke coil in accordance with claim 3 wherein said cap is bonded to a circumferential end face of each said three flanges.

5. A choke coil in accordance with claim 1 wherein said first magnetic core includes an E-shaped magnetic core part and a substantially I-shaped magnetic core part which, in combination, form a B-shaped magnetic circuit.

6. A choke coil in accordance with claim 1 wherein said second magnetic core includes two U-shaped magnetic cores which, when inserted into said hole, form said closed magnetic circuit.

* * * * *